US006092658A

United States Patent [19]

Pietrafesa

[11] Patent Number: 6,092,658

[45] Date of Patent: Jul. 25, 2000

[54] SIMULATED BABY BOTTLE GIFT PACKAGE

[75] Inventor: Michael Pietrafesa, Brooklyn, N.Y.

[73] Assignee: Goldberger Doll Mfg. Co., Inc., Brooklyn, N.Y.

[21] Appl. No.: 09/008,836

[22] Filed: Jan. 20, 1998

[51] Int. Cl.[7] ..... B65D 73/00

[52] U.S. Cl. ..... 206/457; 206/776; 215/317; 215/320; 446/72

[58] Field of Search ..... 215/11.1, 320, 215/317; 220/787, 789; 206/457, 776; 446/72, 74, 75

[56] References Cited

U.S. PATENT DOCUMENTS

| | | | |
|---|---|---|---|
| 3,118,562 | 1/1964 | Whitney | 220/787 |
| 3,297,193 | 1/1967 | Stevens, Jr. | 220/787 |
| 3,811,565 | 5/1974 | Tancredi | 206/776 |
| 5,069,645 | 12/1991 | Dworman et al. | 206/457 |
| 5,312,282 | 5/1994 | Cooper | 215/11.1 |

*Primary Examiner*—Paul T. Sewell
*Assistant Examiner*—J. Mohandesi
*Attorney, Agent, or Firm*—Hopgood, Calimafde, Kalil & Judlowe, LLP

[57] ABSTRACT

A gift package simulating a baby nursing bottle, the package being composed of a cylindrical container housing a miniature doll or other gift and a molded plastic cap that fits on the open mouth of the container. The container is formed of transparent plastic material, the rim of the mouth being rolled to define an annular bead. The cap has an upper section shaped to simulate the nipple-cap ring of a baby bottle, a lower section in the form of a cylindrical stopper that fits into the mouth of the container, and a circular flange at the junction of these sections. Formed on the stopper section is a circumferential array of ledges which are shaped to permit the ledges to slide into the mouth of the container, the upper ends of the ledges being spaced from the flange to define a circular socket therebetween. To put the cap on, the stopper section is pressed into the mouth of the container to cause the annular bead to snap into the socket, thereby latching the cap in place.

5 Claims, 2 Drawing Sheets

SIMULATED BABY BOTTLE GIFT PACKAGE

BACKGROUND OF INVENTION

1. Field of Invention

This invention relates generally to a gift package which resembles a conventional baby nursing bottle and includes a container housing a gift, and more particularly a package of this type having a removable cap that simulates the nipple cap ring of a baby bottle and fits easily on the mouth of the container, yet is latched in place.

2. Status of Prior Art

A conventional glass or plastic baby nursing bottle to feed milk and other liquids to an infant is provided with a container having an externally-threaded neck onto which is screwed an internally-threaded cap ring supporting a rubber nipple. The assembly of nipple and cap ring is usually referred to as a nipple-cap ring.

It is known to provide a very young child who still uses a baby bottle with a gift package in a form which resembles in appearance a conventional baby nursing bottle but is somewhat larger in scale. The gift is housed in a transparent cylindrical plastic container sealed by a cap shaped to look like a nipple-cap ring.

Thus a young child, who is normally fed with milk delivered by a baby bottle, is given a gift in a package resembling this baby bottle. While this is a new and exciting experience for a child receiving his first gift, particularly since the gift is visible through the transparent container, the experience is not unsettling to the child, for the gift is being seemingly delivered by the same medium that delivers milk.

In one commercially known form of gift package resembling a baby bottle, the gift housed in the transparent container is constituted by an assortment of baby products, such as a baby shampoo, baby lotion, a squeeze toy, a pacifier, and a toy rattle.

A gift package simulating the appearance of a conventional baby bottle is usually not discarded after the gift stored therein is removed, for the package serves to house these articles when after use, they are put back in the container. Hence it is important that the removable cap which closes the container fit easily on the container, yet stay securely thereon.

It is known for this purpose to provide a gift package whose appearance simulates a baby bottle in which the transparent container has an externally-threaded neck of reduced diameter adapted to receive an internally-threaded cap that resembles a standard nipple-cap ring.

A gift package of this type having a screw-on cap is relatively costly to manufacture, for the cylindrical container having a threaded neck of lesser diameter cannot be extruded in tubular form, but must be molded to form two complementary half sections that are then joined together.

In the coin bank disclosed in the Dworman et al. U.S. Pat. No. 4,878,867 a conical cap having a coin slot and a cylindrical lower end section fits snugly into the upper end of an open-ended cylindrical container, and a cylindrical base cap fits snugly into the lower end thereof. To effect a snug fit, the cylindrical section of each cap is provided with a series of circular beads which act as O-rings that frictionally engage the inner cylindrical surface of the container. The drawback to this cap and container assembly is that it is not only difficult to press the cap into the container, but it is even more difficult to withdraw the cap from the container.

SUMMARY OF INVENTION

In view of the foregoing, the main object of this invention is to provide a package simulating a baby nursing bottle composed of a cylindrical container housing a gift and a cap that easily fits into the mouth of the container, yet is latched in place.

As significant advantage of a package in accordance with the invention is that the cap is easy to apply to the container and to remove therefrom whereby the package can serve to store the gift when each time after the gift is put to use it is put back in the container. Thus if the gift is a doll which a child receiving of the gift will play with on occasion, at the conclusion of play, the doll is returned to the package and safely stored therein until the next play period.

More particularly an object of the invention is to provide a gift package whose cap is shaped to resemble the nipple-cap ring of a conventional baby bottle includes a cylindrical stopper section that slides smoothly into the open mouth of a cylindrical container.

Also an object of this invention is to provide a gift package of the above type that can be mass-produced at relatively low cost.

Briefly stated, these objects are attained by a gift package simulating a baby nursing bottle, the package being composed of a cylindrical container housing a miniature doll or other gift and a molded plastic cap that fits into the mouth of the container. The container is formed of transparent plastic material, the rim of the mouth being rolled to define an annular bead. The cap has an upper section shaped to simulate the nipple-cap ring of a baby bottle, a lower section in the form of a cylindrical stopper that fits into the mouth of the container, and a circular flange at the junction of these sections.

Formed on the stopper section is a circumferential array of ledges which are shaped to permit the ledges to slide into the mouth of the container, the upper ends of the ledges being spaced from the flange to define a circular socket therebetween. To put the cap on, the stopper section is pressed into the mouth of the container to cause the annular bead to snap into the socket, thereby latching the cap in place.

BRIEF DESCRIPTION OF DRAWING

For a better understanding of the invention, as well as other objects and further features thereof, reference is made to the following detailed description to be read in conjunction with the accompanying drawing, wherein.

DETAILED DESCRIPTION OF INVENTION

Figure 1:
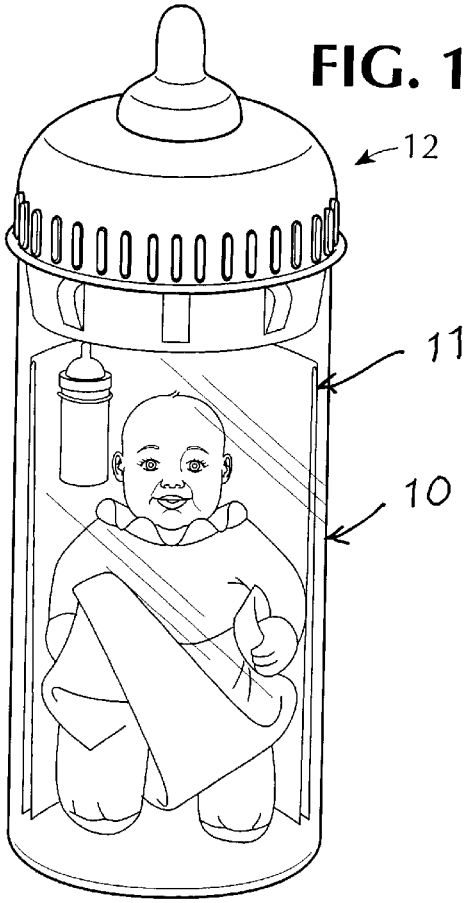
FIG. 1 is a perspective view of a gift package in accordance with the invention, the gift being a miniature baby doll.

Referring now to FIG. 1, there is illustrated in this figure a gift package in accordance with the invention having an appearance resembling a conventional baby nursing bottle. The package is composed of a cylindrical container 10 housing a gift insert 11 and a removable cap 12 that fits onto the open mouth of container 10.

Figure 2:
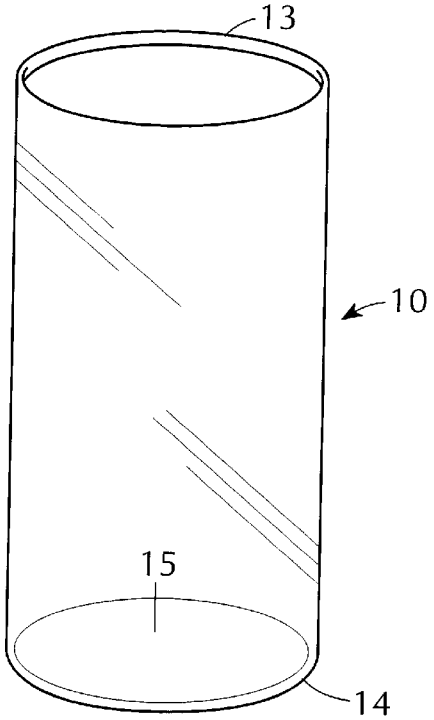
FIG. 2 is a separate perspective view of the cylindrical container included in the package.
Figure 3:
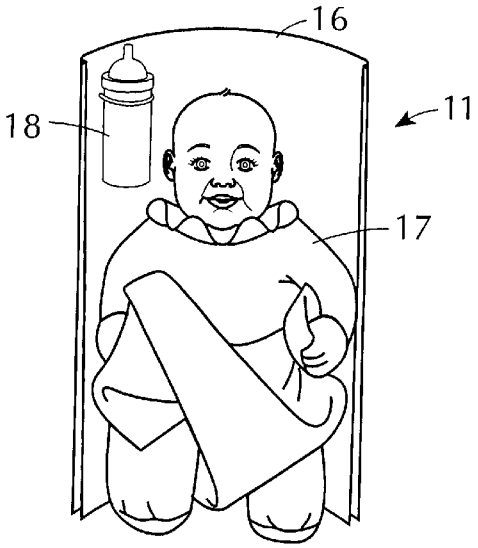
FIG. 3 shows the baby doll insert which goes into the container.
Figure 4:
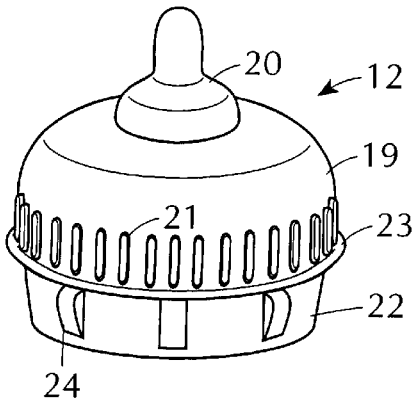
FIG. 4 is a separate view of the cap of the container.
Figure 5:
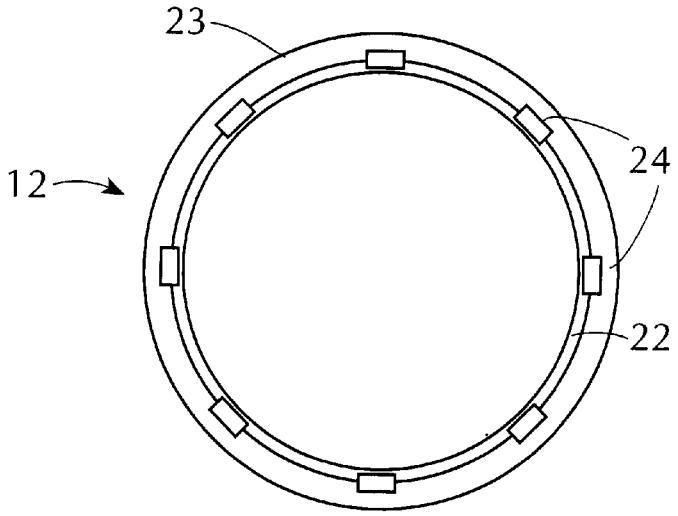
FIG. 5 is a bottom view of the cap.

As shown separately in FIG. 2, container 10 is formed of an open-ended tube of synthetic plastic flexible material, such as polyvinyl chloride or polyethylene. The upper end of container 10 has an open mouth whose rim is rolled to define an annular bead 13.

The lower end of cylindrical container 10 has a rim which is rolled to define an annular bead 14 on which is seated a disc 15 of the same transparent plastic material to close the bottom end of the tubular container and also to maintain its cylindrical shape.

Insert 11 which is received in the cylindrical container includes a rectangular panel 16 of cardboard or other flexible sheet material. The panel is flexed to form a concave mounting that fits snugly into the container and seeks to unbend to engage the arcuate wall of the container.

Mounted on cardboard panel 16 is a miniature baby doll 17 and an adjacent miniature baby bottle 18 for feeding the doll. Gift insert 11 is by way of example only, for in practice the gift may take other forms suitable for the recipient of the gift, such as a small squeeze toy and other small articles which are visible through the transparent container.

Cap 12 which is hollow and light weight is molded of an opaque synthetic plastic material of high strength, such as polypropylene. Cap 12 includes an upper section 19 resembling the cap ring of a conventional baby bottle which supports a nipple 20. Formed on cap ring 19 is a circumferential array of ribs 21 defining a grippng thread for the fingers of the user who applies the cap to the container to close it and later pulls the cap from the container to open it. Essential to the invention is a cap that is easy for a user to apply to the container and to withdraw therefrom.

Cap 12 is provided with a cylindrical lower section 22 whose diameter is slightly smaller than the inner diameter of the open mouth of container 10 to form a stopper. At the junction of lower section 22 and upper section 19 of cap 12 is a circular flange 23 whose diameter is greater than the diameter of cap ring 19.

Figure 6:
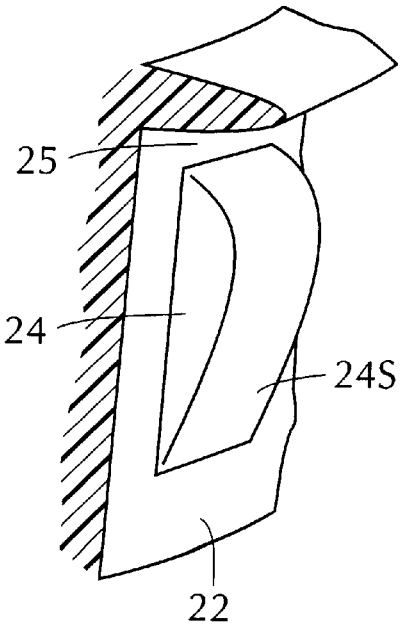
FIG. 6 shows one of the ledges formed on the lower section of the cap.

Formed on the surface of lower stopper section 22 in a circumferential array of equi-spaced vertical ledges 24. Each ledge 24, which projects from the surface of the stopper, as shown in FIG. 6, has a contoured outer surface 24S that is downwardly sloped whereby when the stopper of the cap is pressed into the open mouth of container 10, ledges 24 then frictionally engage bead 13 and slide into the mouth of the container.

Figure 7:
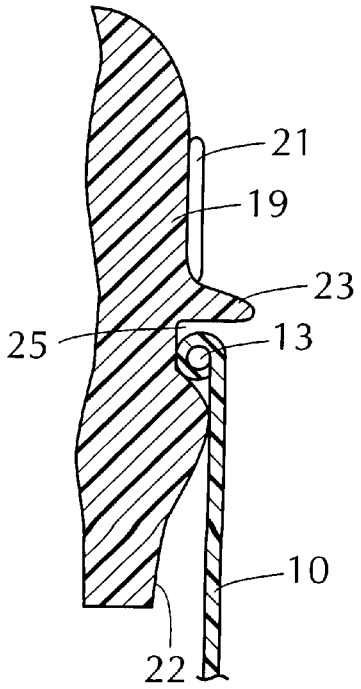
FIG. 7 is a section taken through a portion of the cap when inserted in the mouth of the container.

The upper ends of the array of ledges 24 all of which are on the same level, are equi-spaced from flange 23 to define in the space therebetween a circular socket 25. When as shown in FIG. 7, stopper section 22 of the cap is pressed into the open mouth of container 10, the annular bead 13 at the rim of the open mouth, then snaps into circular socket 25 in the cap, thereby latching the cap in place.

It takes little effort to press cap 12 into the mouth of the container, yet once the cap is latched in place, the cap is then securely held and will not fall off the container even if the gift package is roughly handled. And it takes little effort to pull the cap off the container, for a twisting motion of the cap will unlatch it from the container.

While there has been shown and described a preferred embodiment of a simulated baby bottle gift package in accordance with the invention, it will be appreciated that many changes may be made thereon within the spirit of the invention. Thus the cap which simulates a nipple-cap ring can be provided with a coin slot so that when the container is empty it may serve as a coin bank. And instead of the cap simulating nipple cap ring it may be molded to simulate the head of a Teddy Bear of other animal-like or humanoid figure. Also the gift inserted in the container need not be mounted on a panel wall but may be a doll or other gift that is retained in the container by a fastener.

I claim:

1. A gift package comprising:

A. a cylindrical container formed of flexible synthetic plastic material for accommodating a gift, said container being formed of transparent plastic material to expose the gift housed therein, said container having an open mouth provided with a rolled rim defining an annular bead; and B. a cap having a circular flange, below which is a cylindrical stopper section that is pressable into the mouth of the container, said cylindrical section having formed thereon a circumferential array of vertical ledges whose upper ends are equi-spaced from the flange to define between the flange and the upper ends of the ledges a circular socket dimensioned to accommodate the annular bead of the container whereby when the cap is applied to the container and the stopper section is pressed into the mouth thereof, this causes the annular bead to snap into the socket to latch the cap, said vertical ledges having a downwardly-sloped contoured surface to cause the ledges to slide into the mouth of the container when the stopper section of the cap is pressed into the mouth.

2. A gift package, as set forth in claim 1, in which the cap has an upper section above the flange which is shaped to simulate the appearance of a nipple-cap ring of a conventional baby nursing bottle.

3. A gift package as set forth in claim 2, in which the cap is molded of synthetic plastic material, and the cap ring of the upper section is provided with a circumferential array of ribs to define a friction tread.

4. A gift package as set forth in claim 1, in which accommodated in the container is a miniature doll.

5. A gift package as set forth in claim 4, in which said miniature doll is mounted on a rectangular panel of flexible material that is flexed to form a concave panel that engages an arcuate wall of the cylindrical container.

* * * * *